US009828705B1

(12) United States Patent
Shiue

(10) Patent No.: US 9,828,705 B1
(45) Date of Patent: Nov. 28, 2017

(54) MULTIPLE-LAYER KNITTED FABRIC FOR DISSIPATING SWEAT IN DUAL PHASES

(71) Applicant: Heng-Hsing Shiue, Wujie (TW)

(72) Inventor: Heng-Hsing Shiue, Wujie (TW)

(73) Assignee: SHEI CHUNG HSIN IND. CO., LTD., Wujei (TW)

( * ) Notice: Subject to any disclaimer, the term of this patent is extended or adjusted under 35 U.S.C. 154(b) by 0 days.

(21) Appl. No.: 15/279,388

(22) Filed: Sep. 28, 2016

(51) Int. Cl.
*D04B 1/12* (2006.01)
*D04B 1/16* (2006.01)

(52) U.S. Cl.
CPC *D04B 1/12* (2013.01); *D04B 1/16* (2013.01)

(58) Field of Classification Search
CPC ..... D04B 1/16; D04B 1/18; D04B 9/34
See application file for complete search history.

(56) References Cited

U.S. PATENT DOCUMENTS 3,793,851 A * 2/1974 Thorneburg ..... D04B 1/02 66/185
4,172,370 A * 10/1979 Safrit ..... D04B 1/02 66/178 R
4,373,361 A * 2/1983 Thorneburg ..... A41B 11/02 2/241
4,422,307 A * 12/1983 Thorneburg ..... A41B 11/003 2/239
4,898,007 A * 2/1990 Dahlgren ..... A41B 11/003 2/239
5,312,667 A * 5/1994 Lumb ..... D04B 1/24 428/91
5,547,733 A * 8/1996 Rock ..... B32B 5/26 2/400
5,735,145 A * 4/1998 Pernick ..... D04B 1/16 604/378
6,194,332 B1 * 2/2001 Rock ..... D04B 1/14 442/123
6,427,493 B1 * 8/2002 Kasdan ..... D04B 1/16 66/169 R
7,360,378 B2 * 4/2008 Foshee ..... D04B 1/14 66/196
7,552,603 B2 * 6/2009 Dahlgren ..... A41B 11/00 2/239

* cited by examiner

*Primary Examiner* — Danny Worrell

(57) ABSTRACT

A multiple-layer knitted fabric includes: an inner composite layer formed with hydrophilic yarn and hydrophobic yarn adapted to be contacted with a wearer's skin: an outer dissipating layer formed with hydrophilic yarn or hydrophobic yarn adapted for dissipating moisture and heat outwardly: and a spacer layer integrally formed between the inner and outer layers and formed with hydrophilic yarn for absorbing the moisture of the wearer's sweat from the inner layer and temporarily storing the moisture in the spacer layer, through which the moisture is gradually outwardly transported into the outer layer and then dissipated into the outside atmosphere: thereby keeping the wearer's cool in summer and warm in winter for enforcing his or her comfortable wearing.

12 Claims, 2 Drawing Sheets

MULTIPLE-LAYER KNITTED FABRIC FOR DISSIPATING SWEAT IN DUAL PHASES

BACKGROUND OF THE INVENTION

In U.S. Pat. No. 6,918,140, a multi-layer protective fabric is disclosed, of which a typical drawing, FIG. 2, is depicted as prior art in this application and illustrated in FIG. 3 of this application.

As shown in FIG. 3 of this application, a three-layer construction (40) is disclosed and includes an inside layer (50) containing hydrophobic material, an outside layer (60) containing hydrophilic material, and an intermediate layer (70) spaced between the inside layer (50) and the outside layer (60) and is made of hydrophobic yarn (71) in the intermediate layer (70). In this prior art, it is said that moisture and heat are transferred from the wearer's skin by the inside layer (50) and the intermediate layer (70) to the outside layer (60) and then transferred to they atmosphere.

However, such a prior art has the following drawbacks:

1. The vapor of the wearer's sweat when transferred from the inside layer (50) to the intermediate layer (70) which is made of hydrophobic material may be condensed and then drained downwardly through the hydrophobic yarn. Such a downward draining of condensate may retard the vapors as vaporized upwardly or outwardly, thereby reducing the moisture transport efficiency or decreasing the sweat expelling effect to cause uncomfortableness of the wearer.
2. The inside layer (50) is formed with hydrophobic material through the hole inside layer. Such hydrophobic inside layer (50) may only transport wearer's sweat outwardly by its capillary effect. If the wearer excretes so mach sweat, the hydrophobic inside layer (50) may not efficiently transport the sweat of large quantity outwardly and the sweat as accumulated at the interface between the inside layer and the wearer's skin may cause him or her uncomfortable, or even with cold or "chill" feeling.

The present inventor has found the drawbacks of the prior art and invented the present fabric for efficiently dissipating the wearer's sweat outwardly.

SUMMARY OF THE INVENTION

The object of the present invention is to provide a multiple-layer knitted fabric including: an inner composite layer formed with hydrophilic yarn and hydrophobic yarn adapted to be contacted with a wearer's skin: an outer dissipating layer formed with hydrophilic yarn or hydrophobic yarn for dissipating moisture and heat outwardly: and a spacer layer integrally formed between the inner and outer layers and formed with hydrophilic yarn for absorbing the moisture of the wearer'sweat from the inner layer and temporarily storing the moisture in the spacer layer, through which the moisture is gradually outwardly transported into the outer layer and then dissipated into the outside atmosphere: thereby keeping the wearer's cool in summer and warm in winter for enforcing his or her comfortable wearing.

DETAILED DESCRIPTION

Figure 1:
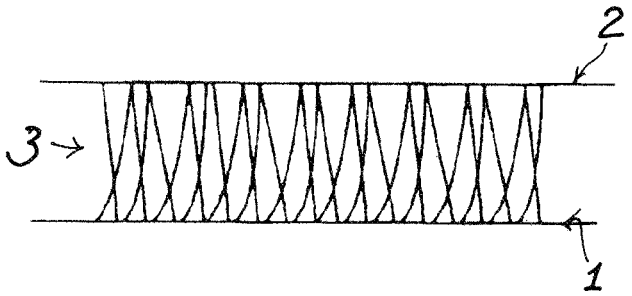
FIG. 1 is a sectional illustration of the present invention.
Figure 2:
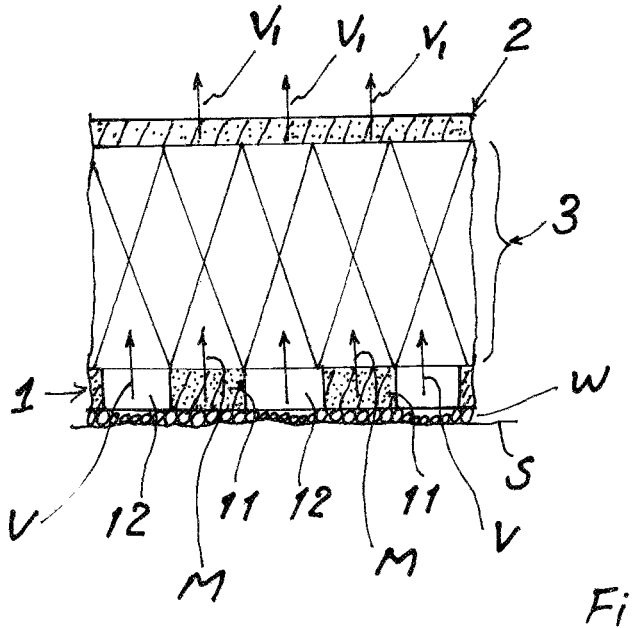
FIG. 2 is an enlarged-view illustration showing the multiple layers of the fabric in contact with a wearer in accordance with the present invention.
Figure 3:
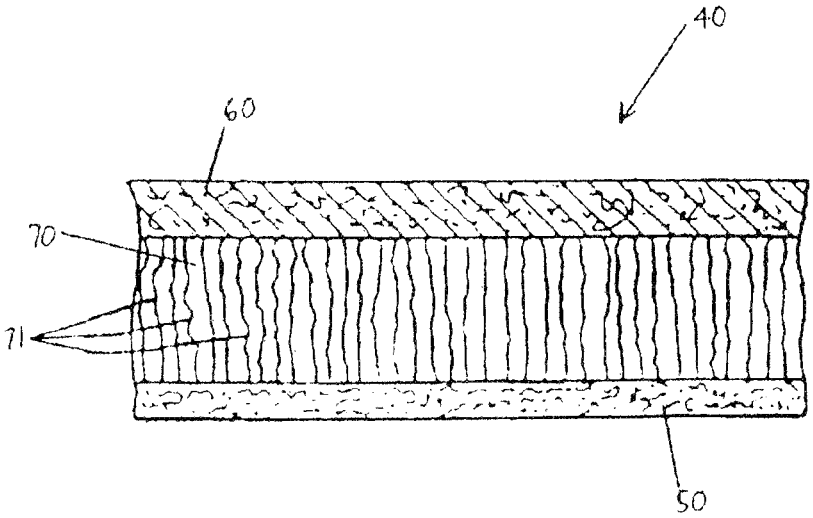
PRIOR ART Fig. 3
FIG. 3 shows a prior art of conventional multi-layer fabric.

As shown in FIGS. 1 and 2, the present invention comprises: an inner composite layer 1; an outer dissipating layer 2; and a spacer layer 3 integrally formed between the inner composite layer 1 and the outer dissipating layer 2.

The inner composite layer 1 includes a hydrophilic yarn 11 and a hydrophobic yarn 12 knitted with the hydrophilic yarn 11. The hydrophilic yarn 11 plays a role as a moisture transport medium for absorbing the moisture M contained in the sweat W as released from a wearer's skin S as shown in FIG. 2. While the hydrophobic yarn 12 plays a role as a vapor transport channel passing the vapor V outwardly as vaporized from the wearer's skin S through the hydrophobic yarn 12 and for radiating body heat outwardly through the hydrophobic layer 12.

The hydrophilic yarn 11 is juxtaposed to the hydrophobic yarn 12 so as to parallelly transfer the moisture M outwardly through the hydrophilic yarn 11 and transfer the vapor V outwardly through the hydrophobic yarn 12, thereby outwardly transporting the moisture M and the vapor V very quickly and efficiently from the wearer's skin S. In other word, the sweat W as accumulated at the interface between the wearer's skin S and the fabric of the present invention will be quickly smoothly transferred outwardly to keep the wearer dry and make him or her comfortable, without cold or "chill" feeling.

So, the title is designated as "Multiple-layer knitted fabric for dissipating sweat in dual phases", namely, one way of liquid phase by outwardly transferring the liquid water droplets or moisture M in the wearer's sweat W through the hydrophilic yarn 11; and the other way of vapor phase by outwardly transferring the vapor V from the wearer's skin S, thereby guiding the moisture M and vapor V outwardly in two ways without mutual conflict retardment of the outward dissipation of moisture and vapor caused by the sweat and body heat of the wearer.

The hydrophilic yarn 11 may occupy an area percentage ranging from 20~50% of the total area of the inner composite layer 1; and the hydrophobic yarn 12 may occupy an area percentage ranging from 50~80% of the total area of the inner composite layer 1.

The inner composite layer 1 may be made of yarns including: polyester or Nylon, added with (or without being added with) Spandex. However, the yarns for making the inner composite layer 1 are not limited in the present invention.

The area percentage of the hydrophilic yarn 11 and the hydrophobic yarn 12 may be designed by manual or by computer in a pre-determined ratio, with plural patterns or knitting processes, not limited in the present invention.

The outer dissipating layer 2 is formed with hydrophilic yarn for the whole layer or hydrophobic yarn for the whole layer. The outer dissipating layer 2 may be formed with polyester or Nylon, added with or without being added with Spandex.

The spacer layer 3 is made of hydrophilic yarn including polyester or nylon. The spacer layer 3 may have a thickness which is preferably ranging from 1~3 times of the thickness of either inner layer 1 or outer layer 2.

The spacer layer 3 as made of hydrophilic yarn may absorb the moisture of the sweat as transferred from the inner layer 1. Therefore, the moisture or sweat as accumulated at the interface between the wearer's skin and the fabric of the present invention (FIG. 2) may be quickly absorbed, wicked and transferred from the inner layer 1 into the spacer layer 3 to be temporarily "trapped" or stored in the spacer layer 3.

Nevertheless, the moisture as absorbed or "trapped" in the spacer layer 3 will be successively or continuously absorbed or wicked due to capillary effect to be outwardly transferred into the outer dissipating layer 2, through which the vapor V1 or heat will be evaporated, transferred or removed away from the outer layer 2 into the atmosphere, thereby transporting the moisture or vapor from the wearer's skin through the inner layer 1, the spacer layer 3, and outer layer 2 to be expelled outwardly (into the atmosphere) and thereby keeping the wearer dry, comfortable without cold or chill feeling.

For stressing the essential features and merits of the present invention, a "two-phase" concept to expel sweat and vapor is further explained, in view of FIG. 2, as follows:

A. Liquid Phase Aspect:

The moisture M of sweat, once absorbed by the hydrophilic yarn 11 in the inner layer 1, will be absorbed, wicked and transferred instantly into the spacer layer 3 so as to quickly remove the sweat accumulated in between the inner layer 1 and the wearer's skin S to be "trapped" in the spacer layer 3. Since the spacer layer 3 is made of hydrophilic yarn and has a thickness preferably larger than that of the inner layer 1, the spacer layer 3 plays like a "sponge" to absorb a large quantity of moisture (at liquid state) in the spacer layer 3, whereby the moisture will still be transferred outwardly by the outer layer 2 by absorbing, wicking or capillary flow of the moisture to be dissipated (by evaporation) into the atmosphere. So, there is no "reverse flow" of moisture or water droplets backward or downwardly from the spacer layer 3 towards the inner layer 1 or the wearer's skin.

B. Vapor Phase Aspect:

The vapor V of wearer's skin or body as vaporized or released from the wearer towards the inner layer 1 is passing in a path through the hydrophobic yarn 12 of the inner layer 1. The vapor V may be laden in a "hot air" as convected or transferred from the wearer's skin towards the hydrophobic yarn 12 in the inner layer 1 and the spacer layer 3. The hydrophobic yarn 12 in the inner layer 1 is water repellent and will not absorb the vapor V. However, the capillaries in the hydrophobic yarn 12 still provide paths for transferring the vapor (or water molecules) outwardly through the inner layer 1 into the spacer layer 3. The vapor V is rapidly guided into the spacer layer 3. At this time, partial vapor may be condensed within the spacer layer 3. But there is no need to worry about the condensate of the condensed vapor which may retard the outgoing or uprising vapor from the inner layer 1 into the spacer layer 3. This is because the spacer layer 3 is so thick or large enough so that the little vapor condensate as absorbed in the spacer layer 3 will soon be dispersed, spread or distributed into the large area or volume within the spacer layer 3. So, the vapor condensate to hinder the outgoing vapor is almost uninfluenced and may be neglected for the overall outward expelling of sweat, even in vapor state.

Accordingly, the present invention discloses a "Dual Phases" concept to expel the s at both in liquid phase and in vapor phase is very practical, efficient and beneficial for a multiple-layer fabric in accordance with the present invention. Such a "Dual-phase" concept to dissipate sweat of this intention is novel and much improved over the prior arts.

The spacer layer 3 is integrally formed with the inner composite layer 1 and the outer dissipating layer 2 by knitting process, such as by means of a double-knit circular knitting machine, to produce a basic knitted fabric with multiple layers or three layers as shown in FIGS. 1 and 2.

The total thickness of the present invention consisting of the inner layer 1, the spacer layer 3 and the outer layer 2 may range from 1~5 mm.

The spacer layer 3 with proper thickness will keep the wearer cool in summer and warm in winter. For making the wearer warmer in winter season, an infrared powder, for instance, may be added in the spacer layer 3. Such infrared powder as added into the fabric of the present invention may emit a far-infrared ray to excite the wearer's skin to stimulate and accelerate his or her blood circulation and metabolism to get a high body temperature, thereby keeping the wearer warm, especially in cold weather or area. Moreover, the thick spacer layer 3 may increase the flexibility and resilience of the fabric product as made by the present invention to thereby enhance a comfortable cushioning or safe protection for the wearer.

The greige fabric knitting as produced as aforementioned may be further processed to be a commercial available fabric product.

For the yarns containing Spandex, the greige fabric is further processed with the following steps:

Greige fabric knitting→Water washing→Pre-setting→Dyeing→Post-setting→Final textile products.

For the yarns without Spandex, the following steps may be applied:

Greige fabric knitting→Dyeing→Post-setting→Final textile products.

The present invention may be further modified without departing from the spirit and scope of the present invention.

I claim:

1. A multiple-layer knitted fabric comprising:

an inner composite layer formed with hydrophilic yarn and hydrophobic yarn and adapted to be contacted with a wearer's skin for absorbing moisture in wearer's sweat and for discharging vapor or heat from the wearer's skin;

an outer dissipating layer formed with yarn selected from hydrophilic yarn and hydrophobic yarn for dissipating vapor or heat outwardly as originally transferred from the wearer's skin; and a spacer layer formed with hydrophilic yarn and integrally formed between said inner composite layer and said outer dissipating layer, and operatively absorbing the moisture as transferred from said inner composite layer and allowing the vapor or heat from said wearer as passing through said inner composite layer to continuously pass through said spacer layer, whereby the wearer's sweat moisture at liquid phase is transferred through the hydrophilic yarn in said inner composite layer into said spacer layer to be evaporated and dissipated outwardly into the atmosphere through said outer dissipating layer; and the wearer's vapor at vapor phase is transferred from said hydrophobic yarn in said inner composite layer, through said spacer layer and through said outer dissipating layer to be dissipated outwardly to effectively expel wearer's sweat outwardly in dual phases of liquid phases and vapor phase.

2. A multiple-layer knitted fabric according to claim 1, wherein said hydrophilic yarn is formed in said inner composite layer to occupy a first area in said inner composite layer and said first area juxtaposed to a second area as occupied by said hydrophobic yarn as formed in said inner composite layer.

3. A multiple-layer knitted fabric according to claim 1, wherein said hydrophilic yarn occupies an area percentage ranging from 20~50% of the total area (100 area %) of said inner composite layer.

4. A multiple-layer knitted fabric according to claim 1, wherein said by hydrophobic yarn occupies an area percentage ranging from 50~80% of the total area (100 area %) of said inner composite layer.

5. A multiple-layer knitted fabric according to claim 1, wherein said inner composite layer is made of yarns including polyester or nylon; added with Spandex.

6. A multiple-layer knitted fabric according to claim 1, wherein said inner composite layer is made of yarns including polyester or nylon.

7. A multiple-layer knitted fabric according to claim 1, wherein said outer dissipating layer is made of yarn, including polyester or nylon; added with Spandex.

8. A multiple-layer knitted fabric according to claim 1, wherein said outer dissipating laser is made of yarn, including polyester or nylon.

9. A multiple-layer knitted fabric according to claim 1, wherein said spacer layer is made of hydrophilic yarn selected from polyester and nylon, and having a thickness which is 1~3 times of the thickness of either said inner composite layer or said outer dissipating layer.

10. A multiple-layer knitted fabric according to claim 1, wherein said spacer layer is added with infrared powder therein.

11. A multiple-layer knitted fabric according to claim 1, wherein said inner composite layer, said outer dissipating layer and said spacer layer are integrally formed by knitting process.

12. A multiple-layer knitted fabric according to claim 1, wherein said inner composite layer, said outer dissipating layer and said spacer layer are knitted to integrally form a triple-layer knitted fabric by means of a double-knit circular knitting machine.

* * * * *